US008844759B2

(12) United States Patent
Dubois

(10) Patent No.: US 8,844,759 B2
(45) Date of Patent: Sep. 30, 2014

(54) TRANSPORT CONTAINER

(75) Inventor: Jean-Marc Dubois, Bremgarten (CH)

(73) Assignee: Georg Utz Holding AG, Bremgarten (CH)

( * ) Notice: Subject to any disclaimer, the term of this patent is extended or adjusted under 35 U.S.C. 154(b) by 133 days.

(21) Appl. No.: 12/737,638

(22) PCT Filed: Aug. 6, 2009

(86) PCT No.: PCT/IB2009/006927

§ 371 (c)(1),
(2), (4) Date: Feb. 1, 2011

(87) PCT Pub. No.: WO2010/018462

PCT Pub. Date: Feb. 18, 2010

(65) Prior Publication Data

US 2011/0127275 A1 Jun. 2, 2011

(30) Foreign Application Priority Data

Aug. 12, 2008 (DE) ..... 10 2008 038 670
Sep. 17, 2008 (DE) ..... 10 2008 047 586

(51) Int. Cl.
*B65D 1/48* (2006.01)
*B65D 1/22* (2006.01)

(52) U.S. Cl.
CPC ..... *B65D 1/22* (2013.01); *B65D 2501/24821* (2013.01); *B65D 1/48* (2013.01); *B65D 2501/24777* (2013.01); *B65D 2501/2484* (2013.01)
USPC ..... 220/646; 220/669; 220/645; 220/62.2; 220/62.19; 220/62.11

(58) Field of Classification Search
CPC ..... B65D 11/16; B65D 11/20; B65D 11/22; B65D 15/00; B65D 15/08; B65D 15/14; B65D 90/028
USPC ..... 220/1.5–1.6, 62.17, 62.19, 62.2, 62.22, 220/626–627, 645–646, 669–671, 673, 675, 220/677–678, 681, 692, 694–694.1, 699
IPC ..... B65D 1/22, 1/48, 6/00, 6/10, 6/14, B65D 6/28, 6/32, 6/34
See application file for complete search history.

(56) References Cited

U.S. PATENT DOCUMENTS 574,987 A * 1/1897 Farrell ..... 220/62.2
3,501,047 A 3/1970 Raabe (Continued)

FOREIGN PATENT DOCUMENTS

CH 683091 A5 * 1/1994
DE 92 06 973 9/1992

(Continued)

OTHER PUBLICATIONS

International Search Report.

*Primary Examiner* — Mickey Yu
*Assistant Examiner* — Brijesh V. Patel
(74) *Attorney, Agent, or Firm* — Collard & Roe, P.C.

(57) ABSTRACT

The invention relates to a transport container which is made of plastic and has side walls which rise up from a bottom part and are reinforced on their outwardly facing surface by vertical and/or horizontal ribs which protrude from the walls and are characterized in that plates made of plastic filled with stiffness-increasing additives are applied to the outer side of at least two opposing side walls.

8 Claims, 5 Drawing Sheets

(56) References Cited

U.S. PATENT DOCUMENTS

Figure 1:
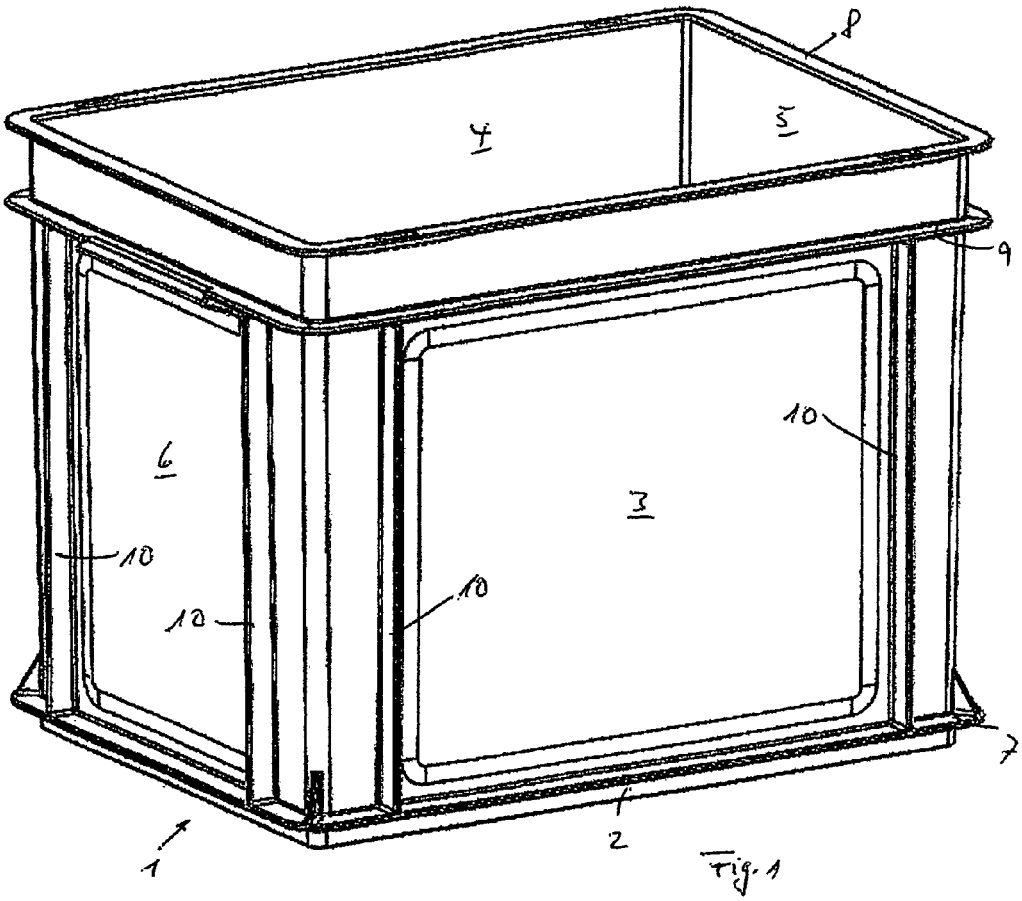

| | | | | | |
|---|---|---|---|---|---|
| 3,620,399 | A | * | 11/1971 | Rapeaud | 215/12.1 |
| 3,622,037 | A | | 11/1971 | Gildart | |
| 3,895,258 | A | * | 7/1975 | Gruetman | 315/371 |
| 4,082,882 | A | * | 4/1978 | Weinstein et al. | 156/285 |
| 4,107,362 | A | * | 8/1978 | Valyi | 215/12.2 |
| 4,597,503 | A | * | 7/1986 | Lates | 220/676 |
| 5,351,846 | A | * | 10/1994 | Carter | 220/6 |
| 5,449,081 | A | * | 9/1995 | Sjostedt et al. | 220/1.5 |
| 5,531,352 | A | * | 7/1996 | Kraft et al. | 220/675 |
| 5,586,675 | A | * | 12/1996 | Borsboom et al. | 220/6 |
| 5,622,306 | A | * | 4/1997 | Grigsby, Sr. | 229/122.27 |
| 5,720,403 | A | * | 2/1998 | Sawyer | 217/65 |
| D415,866 | S | * | 10/1999 | Huang | D34/19 |
| 5,960,975 | A | * | 10/1999 | Lennartsson | 220/62.22 |
| 5,979,684 | A | * | 11/1999 | Ohnishi et al. | 220/1.5 |
| 6,077,579 | A | * | 6/2000 | De Laforcade | 428/35.7 |
| 6,135,287 | A | * | 10/2000 | Hartwall | 206/600 |
| 6,955,273 | B2 | * | 10/2005 | Hartwall | 220/1.6 |
| 2004/0112907 | A1 | * | 6/2004 | Donnelly et al. | 220/660 |
| 2005/0150892 | A1 | * | 7/2005 | Miller | 220/324 |
| 2007/0245651 | A1 | * | 10/2007 | Hardigg et al. | 52/235 |
| 2008/0023538 | A1 | * | 1/2008 | Robertson et al. | 229/403 |
| 2008/0203089 | A1 | * | 8/2008 | Hartwall | 220/1.5 |
| 2009/0114645 | A1 | * | 5/2009 | Zemer | 220/1.5 |
| 2010/0012550 | A1 | * | 1/2010 | Dedmon et al. | 220/4.28 |

FOREIGN PATENT DOCUMENTS

| | | | | |
|---|---|---|---|---|
| FR | 2 591 453 | | | 6/1987 |
| FR | 2 612 493 | | | 9/1988 |
| FR | 2 697 800 | | | 5/1994 |
| GB | 2040880 | A | * | 9/1980 |
| GB | 2103184 | A | * | 2/1983 |
| GB | 2 255 968 | | | 11/1992 |

* cited by examiner

TRANSPORT CONTAINER

CROSS REFERENCE TO RELATED APPLICATIONS

This application is the National Stage of PCT/IB2009/006927 filed on Aug. 6, 2009, which claims priority under 35 U.S.C. §119 of German Application No. 10 2008 038 670.7 filed on Aug. 12, 2008 and German Application No. 10 2008 047 586.6 filed on Sep. 17, 2008, the disclosures of which are incorporated by reference. The international application under PCT article 21(2) was not published in English.

The invention relates to a transport container made of plastic, having side walls that rise from a bottom part, which walls are reinforced, on their surface that faces outward, by means of vertical and/or horizontal ribs that project away from the walls. This can be a small-load or also a large-load carrier, in which the side walls can also be configured in collapsible manner.

Such load carriers are placed on top of one another in the loaded state, so that rather great forces act on the side walls.

The weight and the ability to withstand mechanical stress play an ever greater role, particularly in the case of small-load carriers made of plastic.

The demand for ever greater stacking loads can be met in that more rigid and therefore more brittle materials are used, additional ribs are introduced, predominantly in the corner regions, or steel reinforcements are screwed on or riveted on.

If one manufactures the load carrier from a rigid material, it is true that the stacking load can be increased, but on the other hand, the products break significantly more quickly, as the result of the brittleness of the material.

It is true that additional ribs can increase the stacking load by 20% to 30%, but they are significantly more difficult to clean and increase the weight.

Steel reinforcements are extremely expensive and the combination of plastic and steel is difficult to recycle.

For this reason, the invention is based on the task of configuring a transport container of the type stated initially, in such a manner that while the elasticity of the transport container remains the same, the stacking load can increase by at least 100%, without recycling being connected with additional effort, and without an increase in the weight of the transport container.

The invention accomplishes this task in that panels made of plastic filled with additives that increase stability are applied to the outside of at least two side walls that lie opposite one another.

Stable, rigid panels are applied to a plastic container made of an elastic plastic material, produced in normal manner.

The combination of the two materials fulfills the partial stated task of being able to increase the stacking load without worsening the elasticity of the transport container.

Another advantage of the transport container configured according to the invention that can be named is the cleaning-friendliness that results from the smooth outer surface.

Furthermore, transport container and panel can be recycled together.

However, a main advantage can be seen in that the base container can be produced from an elastic material, whereby furthermore material can be saved, since the actual stability and strength of the container are produced by means of the panels that are applied.

Glass fibers, hemp fibers, steel fibers, talcum, chalk, and similar materials that increase stability can be provided as additives. In addition, however, the panels can also consist of materials that are more rigid in themselves, such as, for example, polyamide, POM, etc.

According to one embodiment, it is provided that the plastic panels filled with the additives are welded onto reinforcement ribs on the surface of the side walls.

Alternatively, it is provided that the plastic panels filled with the additives are screwed onto or riveted onto the reinforcement ribs.

In an advantageous embodiment, it is provided that the plastic panels filled with the additives stand on a rib that runs around the circumference at the level of the bottom of the container, with their lower edge, and that the upper edge of the plastic panel, in each instance, butts up against a rib that surrounds the upper edge of the container and projects outward.

The plastic panel filled with the additives is therefore supported at the bottom and at the top, and therefore can well absorb forces that are introduced vertically into the side walls from above.

Depending on the embodiment and the purpose of use, the plastic panels filled with the additives can be disposed merely in the corner regions of the side wall. This means that the reinforced panels are configured in strip shape and are used in the region in which two side walls abut one another.

Alternatively, it is provided according to claim 6 that the plastic panels filled with the additives are disposed centered on the side walls.

Thus, the panels cover practically the entire surface of a side wall of the base transport container.

In an extreme case, it can, of course, also be provided that such panels made of reinforced plastic are disposed not only centered on the side walls but also in the corner regions.

In order to further increase the stability of such a design, a layer of pressed paperboard is enclosed between the side surface and the plastic panel filled with the additives.

However, a reinforcement composed of metal parts, which are introduced into the interstice, can also be provided.

Alternatively, it can be provided according to one aspect of the invention that a layer of wood is enclosed between side wall surface and the plastic panel filled with the additives, whereby it is provided according to a further aspect that the grain of the wood runs in the direction from the bottom to the edge of the container.

Thus, the forces introduced into the side walls vertically can be absorbed even more effectively.

The additives, for example the glass fibers in the plastic panels, can also have such an orientation, so that a further increase in stacking load is made possible in this way.

In the following, the invention will be shown and explained using drawings.

Figure 2:
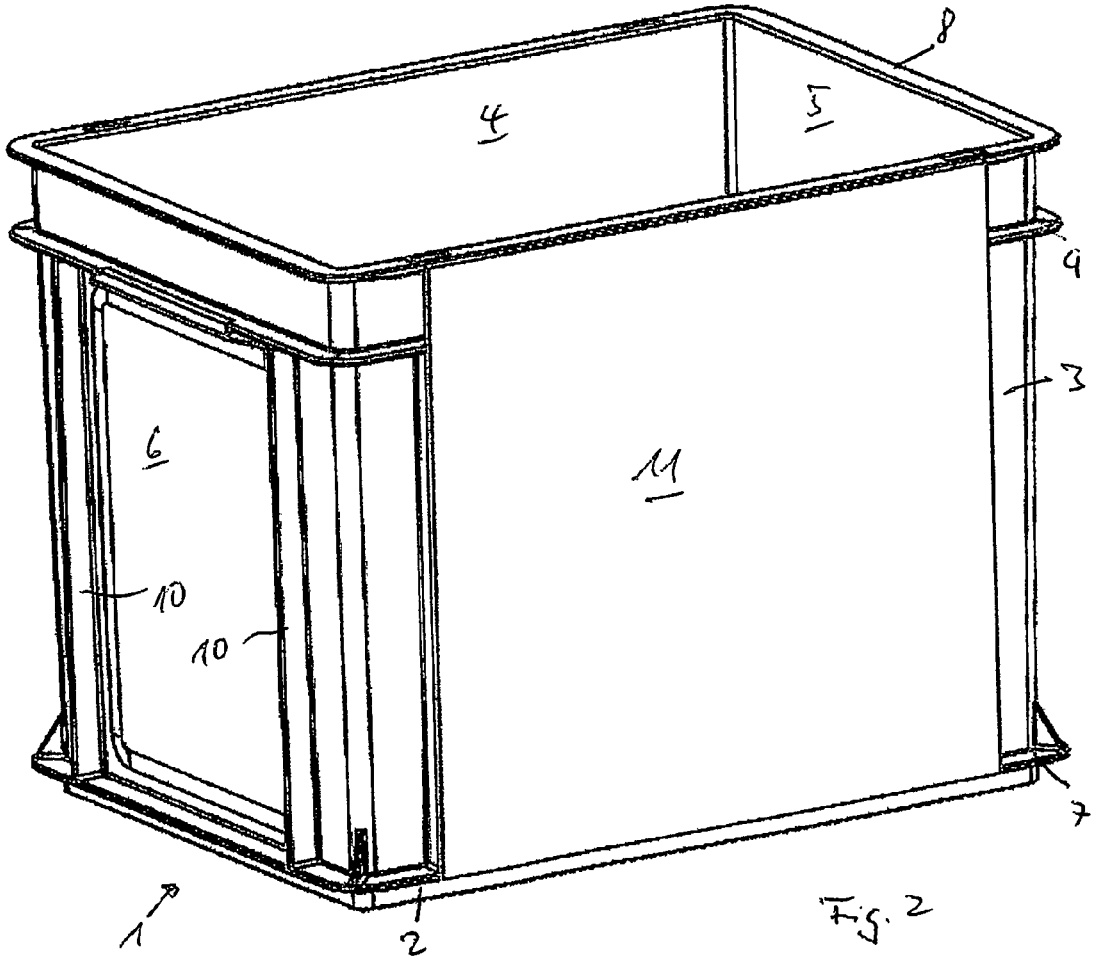
Figure 3:
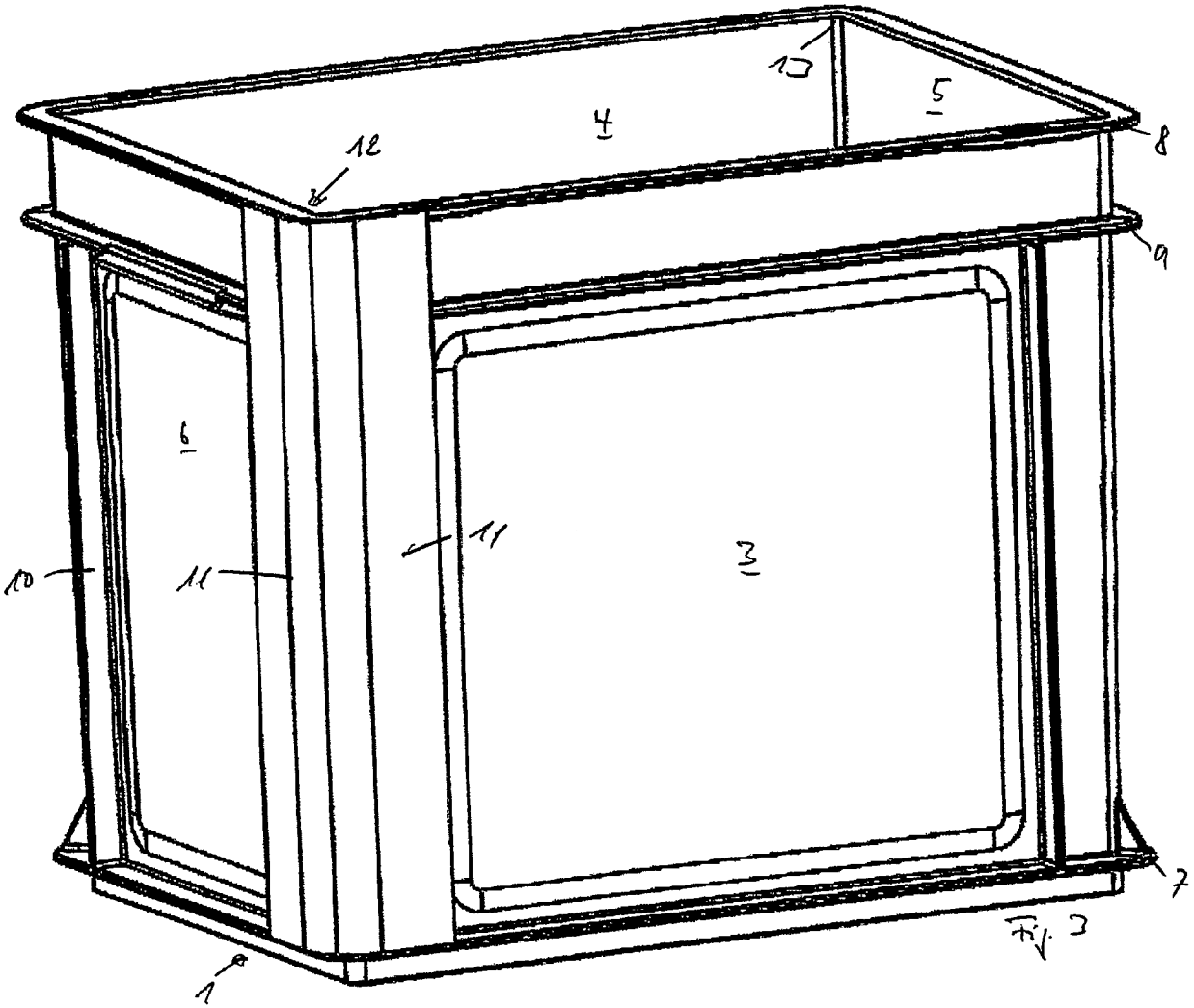
Figure 4:
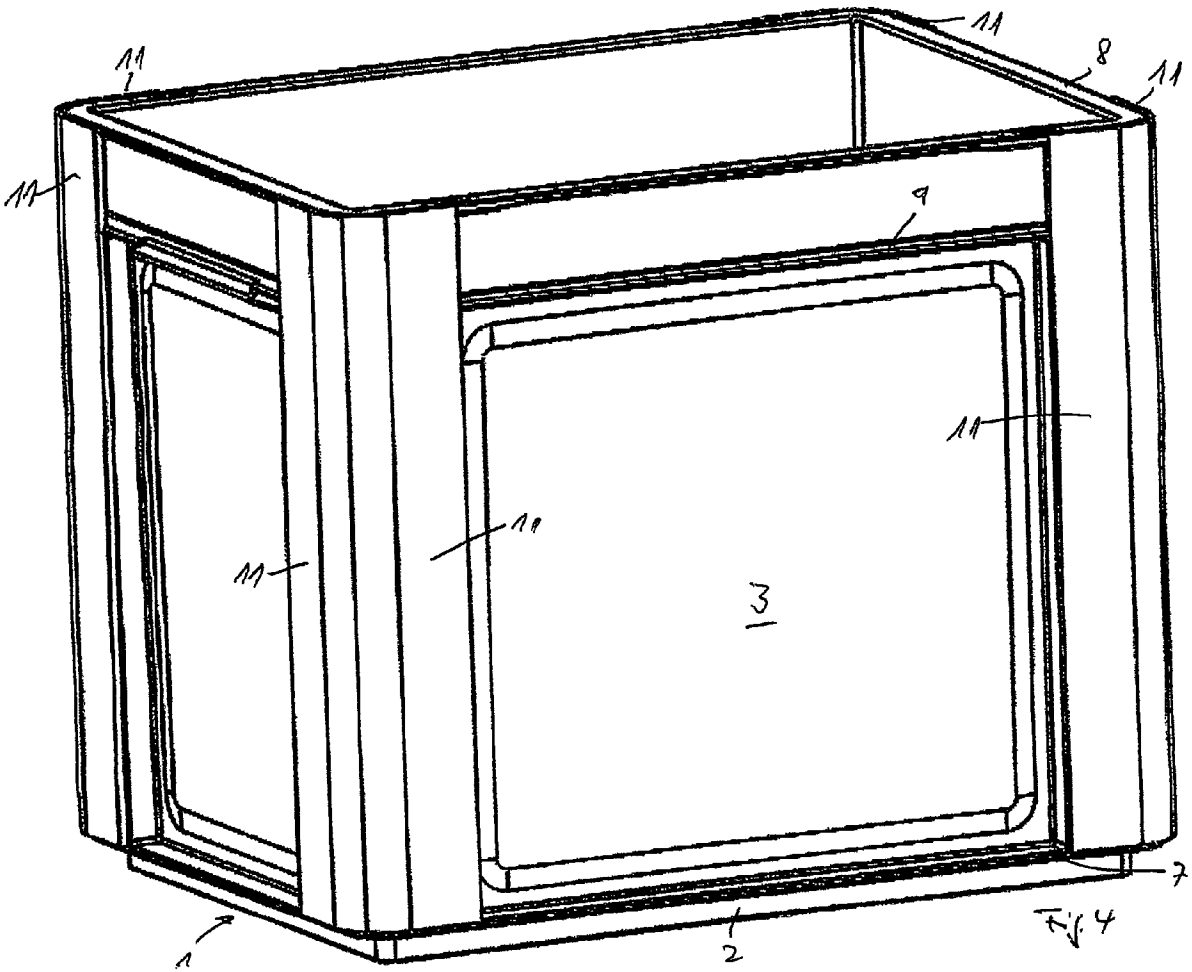
Figure 5:
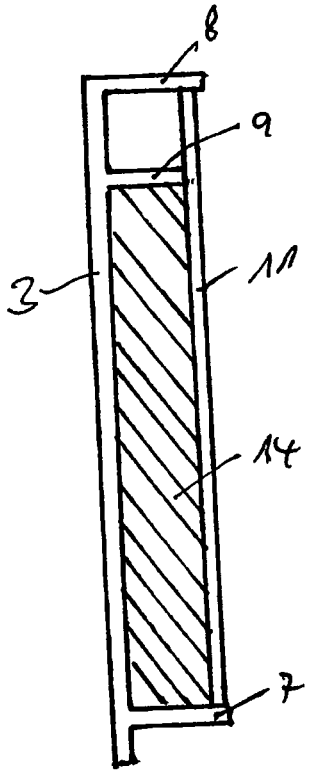

These show:

FIG. 1 a transport container in the non-reinforced state,

FIG. 2 a transport container with side wall reinforcement,

FIG. 3 a transport container with reinforcements in the corner region,

FIG. 4 transport container as in FIG. 3, but with reinforcements in all corner regions, FIG. 5 section through a side wall with additional reinforcement.

In FIGS. 1 to 4, a transport container (small-load carrier or large-load carrier) is shown in a perspective representation, and provided with the reference symbol 1, in general.

It consists of a bottom part 2 and side walls 3, 4, 5, and 6 that rise vertically from this bottom part 2.

In the bottom region, a rib 7 that projects horizontally outward is provided on the circumference. Correspondingly, a rib 8 that projects horizontally outward is provided on the circumference of the upper edge of the container 1.

In the region between these ribs 7 and 8, reinforcement ribs 9 and 10 that run horizontally around the circumference and disposed vertically are provided on the top of the side walls 3 to 6, but these ribs do not project as far outward as the ribs 7 and 8.

For reinforcement of the transport container 1 shown in FIG. 1, a panel 11 made of a fiberglass-reinforced plastic is applied to the side wall 3 and (not shown, to the side wall 4)—as shown in FIG. 2.

This fiberglass-reinforced panel 11 is supported on the lower rib 7, on the one hand, and abuts against the underside of the rib 8 with its upper edge, on the other hand.

In this connection, the fiberglass-reinforced panel 11 covers almost the entire side wall 3, 4. It is welded onto the horizontal or vertical ribs 9 and 10, for example. However, it can also be screwed on or riveted on.

In FIG. 3, a transport container 1 is shown that is merely reinforced in the corner regions 12 and 13 by means of fiberglass-reinforced panels 11, whereby the panels 11 are configured in strip shape here.

Finally, in FIG. 4, an embodiment is shown in which these strip-shaped panels 11 are provided in all the corner regions.

In FIG. 5, a side wall 3 reinforced with a fiberglass-reinforced plastic panel 11 is shown in cross-section, whereby a filler material 14 is provided in the interstice between side wall surface and fiberglass-reinforced panel 11.

This filler material can be pressed paperboard, for example, or also wood, whereby it is advantageous if the wood runs from the bottom to the upper edge of the container 1 in its grain direction. This filler further increases the stacking load capacity of the container, but does not disturb the recycling process, since the paperboard or the wood can be separated by the plastic by means of wind screening.

The invention claimed is:

1. A transport container made of plastic, having side walls that rise from a bottom part, in which the side walls are reinforced, on their outer surface, by means of vertical and/or horizontal ribs that project away from the side walls, wherein plastic panels (11) filled with additives that increase rigidity are applied to the outside of at least two side walls (3, 4) that lie opposite one another, wherein the plastic panels (11) filled with additives stand on a rib (7) that runs around the circumference at the level of the bottom of the transport container (1), with their lower edge, wherein the upper edge of each the plastic panel (11) filled with additives butts up against a rib (8) that surrounds the upper edge of the transport container (1) and projects outward, wherein the plastic panels filled with additives are made of a material having a greater rigidity than a material of the transport container, wherein a layer of filler material is provided between an outer surface of the side walls and the plastic panel filled with additives, wherein the additives are fiber additives, and wherein fibers of the fiber additives are oriented in the direction from the bottom (2) to the upper edge of the transport container (1) in the plastic panels (11) filled with additives.

2. The transport container according to claim 1, wherein the plastic panels (11) filled with additives are welded onto the reinforcement ribs (9, 10).

3. The transport container according to claim 1, wherein the plastic panels (11) filled with additives are screwed onto the reinforcement ribs (9, 10).

4. The transport container according to claim 1, wherein the plastic panels (11) filled with additives are disposed merely in the corner regions (12, 13) of the side walls (3-6).

5. The transport container according to claim 1, wherein the plastic panels (11) filled with additives are disposed centered on the side walls (3-6).

6. The transport container according to claim 1, wherein the filler material is pressed paperboard.

7. The transport container according to claim 1, wherein the filler material is wood.

8. The transport container according to claim 7, wherein the grain of the wood runs in the direction from the bottom (2) to the upper edge of the transport container (1).

* * * * *